US012759751B2

(12) United States Patent
Cohn

(10) Patent No.: US 12,759,751 B2
(45) Date of Patent: Oct. 13, 2026

(54) STABLE CARTON AND METHOD OF MAKING

(71) Applicant: General Mills, Inc., Minneapolis, MN (US)

(72) Inventor: Rebecca Lauren Cohn, Minneapolis, MN (US)

(73) Assignee: General Mills, Inc., Minneapolis, MN (US)

( * ) Notice: Subject to any disclaimer, the term of this patent is extended or adjusted under 35 U.S.C. 154(b) by 413 days.

(21) Appl. No.: 18/367,575

(22) Filed: Sep. 13, 2023

(65) Prior Publication Data

US 2025/0083859 A1 Mar. 13, 2025

(51) Int. Cl.
*B65D 5/02* (2006.01)
*B65D 5/44* (2006.01)

(52) U.S. Cl.
CPC ..... *B65D 5/0254* (2013.01); *B65D 5/443* (2013.01)

(58) Field of Classification Search
CPC ..... B65D 5/0254; B65D 5/0227
USPC ..... 229/5.5, 5.8
See application file for complete search history.

(56) References Cited

U.S. PATENT DOCUMENTS 3,003,677 A * 10/1961 Hennessey ..... B65D 5/0227 229/134
3,679,123 A * 7/1972 Wood ..... B65D 5/0227 229/134
3,934,791 A * 1/1976 Dick ..... B65D 5/0227 229/134
4,501,388 A * 2/1985 Cassidy ..... B65D 5/0227 229/134
4,530,461 A * 7/1985 Adamek ..... B65D 5/4279 229/134
6,318,593 B1 * 11/2001 Laughlin ..... G01F 11/261 222/456
2012/0061456 A1 * 3/2012 Rosas ..... B65D 5/443 229/117.01

FOREIGN PATENT DOCUMENTS

EP 1661813 A1 * 5/2006 ..... B65D 5/4279
GB 2335653 A * 9/1999 ..... B65D 5/0227

* cited by examiner

*Primary Examiner* — Corey N Skurdal
(74) *Attorney, Agent, or Firm* — Jordan IP Law, LLC; Tina Yin Sowatzke, Esq.

(57) ABSTRACT

A stabilized carton having four sides, a bottom and a top with improved structural stability is formed by cutting a notch in one of the lower major flaps and imprinting an embossment into a lower minor flap. The first and second lower minor flaps and the first and second lower major flaps are then folded, forming the bottom of the carton. The embossment is fitted into the notch, providing enhanced stability to the carton. Cut sections formed on a fold line of the flaps and a lower major flap that extends across the bottom of the carton also stabilize the carton.

13 Claims, 6 Drawing Sheets

STABLE CARTON AND METHOD OF MAKING

FIELD OF THE INVENTION

The invention generally pertains to providing changes to the structure and assembly of a carton to increase carton stability on a shelf.

BACKGROUND OF THE INVENTION

Many products are currently sold or stored in cartons. For example, food products are often packaged into paperboard cartons for shipping to retail establishments. The same cartons are placed upright on a shelf in the retail establishment and used to display the food products. Finally, the cartons of food products are purchased by a customer and typically stored upright in a customer's home on a shelf in a cabinet.

Some cartons have a relatively small base compared to a height of the carton. For example, some cartons have a height which is in the order of 3-5 or more times a smaller dimension of the base. By way of a specific example, it is known to package a seasoning packet in combination with a topping sauce (total net weight of 3.9 oz of product) in a box having base dimensions of about 1.25 inches by 4.9 inches versus a height of 5.75 inches. Cereal boxes also commonly have small bases relative to their height. Given these dimensional differences, such cartons are not very stable and tend to tip over. The carton is especially prone to fall upon front or back panels of the carton due to the carton's small depth.

This situation is made worse based on the shape of the base. Since the cartons are typically made by folding a sheet of paperboard or cardboard into a box, the bottom tends to be somewhat rounded and therefore inherently less stable. That is, the box is typically formed with a bottom having a small cross-sectional area and, more importantly, a small depth, an equally small top and four relatively long, upstanding sides. The long sides usually include two wide sides, i.e., larger front and back face panels, and two narrow sides, each with a small area. In one example, three sides of the box are simply formed of a single sheet of cardboard. The fourth side is formed by one end of the sheet overlapping another end of the sheet on one side of the box. The fourth side thus has two layers. By contrast, the bottom of the cardboard box is typically formed of several layers of paperboard folded on top of each other. In particular, each side is formed with a flap, with the narrow sides having short flaps that are first folded toward each other. Then the flaps of the wide sides are folded toward each other and over the short flaps to form the bottom. Given the thickness of the side flaps and these multiple layers sitting atop one another, the bottom of the carton inherently bows outward, preventing the carton bottom from being flat but rather taking a somewhat rounded shape. This rounded shape, as well as the greater height of the carton, translates into the box being rather unstable when supported on the base, leading to the carton tending to tip and fall over.

An unstable carton may fall over at the store, or even on a shelf at a customer's house. Either way, this situation is undesirable and there exists a need in the art for a stable carton or box for containing items, without the need to change the shape or size of the carton, particularly in the food art where the carton is often used to display the product for sale.

SUMMARY OF THE INVENTION

The invention is directed to a carton having a small base relative to a height of the carton but wherein the carton is stable and does not easily tip over. As discussed in more detail below, the carton of the invention incorporates three features which independently function to increase carton stability but which, in one or more combinations, synergistically function to provide for an extremely stable carton configuration, without the need to change the overall carton size or shape.

In general, the carton has six sides, basically taking the form of a rectangular box. However, the carton is dimensionally limited to including relatively large front and rear panels, relatively thin side panels, a small base and a small top. Most importantly, the base is specifically constructed with features resulting in the base being significantly flatter than conventional cartons of similar size and shape. In a manner similar to known cartons, the front panel includes a first lower major flap, and an opposing rear panel includes a second lower major flap. The thin side panels include a first side panel with a first lower minor flap and an opposing second side panel with a second lower minor flap. The panels are arranged to form an interior cavity for storing items such as food. The carton has a bottom formed from the first and second lower minor flaps and first and second lower major flaps. More particularly, the lower minor flaps are folded inward toward each other along fold lines and then the lower major flaps are also folded inward along fold lines, thus forming the bottom of the carton. The top is also formed from flaps extending from the side panels and from the front and rear panels. The top is preferably easily opened to remove the contents of the carton as desired.

However, to enhance product stability in accordance with one aspect of the invention, one of the bottom flaps is formed with a notch having a particular shape. The notch is an area that has been cut out of the bottom flap. Another one of the bottom flaps is formed with an embossment. The embossment is formed by imprinting or pressing the respective flap to form a recess in one side of the first or left lower minor flap and a protrusion on the other side of the first or left lower minor flap. The embossment is sized and shaped so that the embossment fits into the shape of the notch. Preferably, one of the first and second lower major flaps is formed with the notch, and one of the first and second minor flaps is formed with the embossment. More preferably, the notch has a shape that is complementary or closely follows the shape of the embossment. Also, the protrusion preferably extends from the first lower minor flap a distance less than or equal to a thickness of the rear lower major flap. The flaps of the carton are glued to each other to form the carton and so that the carton retains its shape. The embossment on the minor flap helps ensure the glue more tightly seals the minor and major flaps together thus removing the tendency for the bottom of the carton to be rounded. The resulting flat bottom thus increasing the stability of the carton when the carton is placed upright on a shelf.

In accordance with another aspect of the invention, the bottom of the carton is formed by enlarged front lower major flaps. For example, the first lower major flap preferably extends completely across the bottom of the carton. Such an arrangement removes an unstable point at the middle of the bottom of the carton wherein a transition from two to three board thicknesses exists in certain prior art arrangements. A second lower major flap with notches also extends completely across the bottom. Again, this arrangement provides for a carton with a flat bottom and increased stability.

In accordance with a third aspect of the invention, cut sections are employed along the fold line between the rear panel and the rear lower major flap. Each cut section has a cut length, and, between each cut section, the fold line has an uncut length, with the uncut length preferably being longer than the cut length. The rear panel and the second lower major flap are connected along a second fold line, with cut sections also extending along the second fold line. These cut sections that alternate with uncut sections, also referred to as skip cuts, enhance the folding of the bottom forming carton panels. In particular, during manufacturing, the edges formed along the fold lines form an angle that is closer to 90 degrees when compared to folds made without the skipping cuts, thereby further leading to a flatter carton bottom and thus a more stable carton.

The carton can be used to store a wide range of items but preferably contains one or more food items. The dimensions of the carton are such that the carton is taller than it is deep. The carton preferably has a height vs depth ratio of at least 3:1, more preferably 4:1 and, most preferably, greater than 4:1. The embossment cooperates with the notch, the front lower major flap and the cuts, to help prevent the carton from tipping over.

A method of forming stabilized the carton is also disclosed. The method includes first cutting a notch in one of the bottom flaps and imprinting an embossment into another of the bottom flaps. The first and second lower minor flaps are folded toward each other, then the first and second major flaps are folded toward each other while forming the bottom. While the flaps are folded the embossment is fitted into, i.e., located entirely within, the notch. Imprinting the embossment includes pressing the rear lower minor flap to form a recess on one side of the rear lower minor flap and a protrusion on the other side of the rear lower minor flap. Another way to stabilize the carton includes extending the front lower major flap completely across the bottom. A further method of stabilizing the carton includes cutting along a fold line between the rear panel and the rear lower major flap to form cut sections and uncut lengths along the fold line.

It should be noted that all three features can be used in combination and fitting the embossment into the notch; extending the front lower major flap completely across the bottom; and cutting along a fold line between the rear panel and the rear lower major flap to form cut sections and uncut lengths along the fold line; collectively constitute stabilizing the carton by forming a flat bottom of the carton to allow the carton to resist tipping.

The preceding summary is provided to facilitate an understanding of some of the innovative features unique to the present disclosure and is not intended to be a full description. A full appreciation of the disclosure can be gained by taking the entire specification, claims, drawings, and abstract as a whole. Additional objects, features and advantages of the invention will become more readily apparent from the following detailed description when taken in conjunction with the drawings wherein like reference numerals refer to corresponding parts in the several views.

DETAILED DESCRIPTION OF EMBODIMENTS

Figure 1:
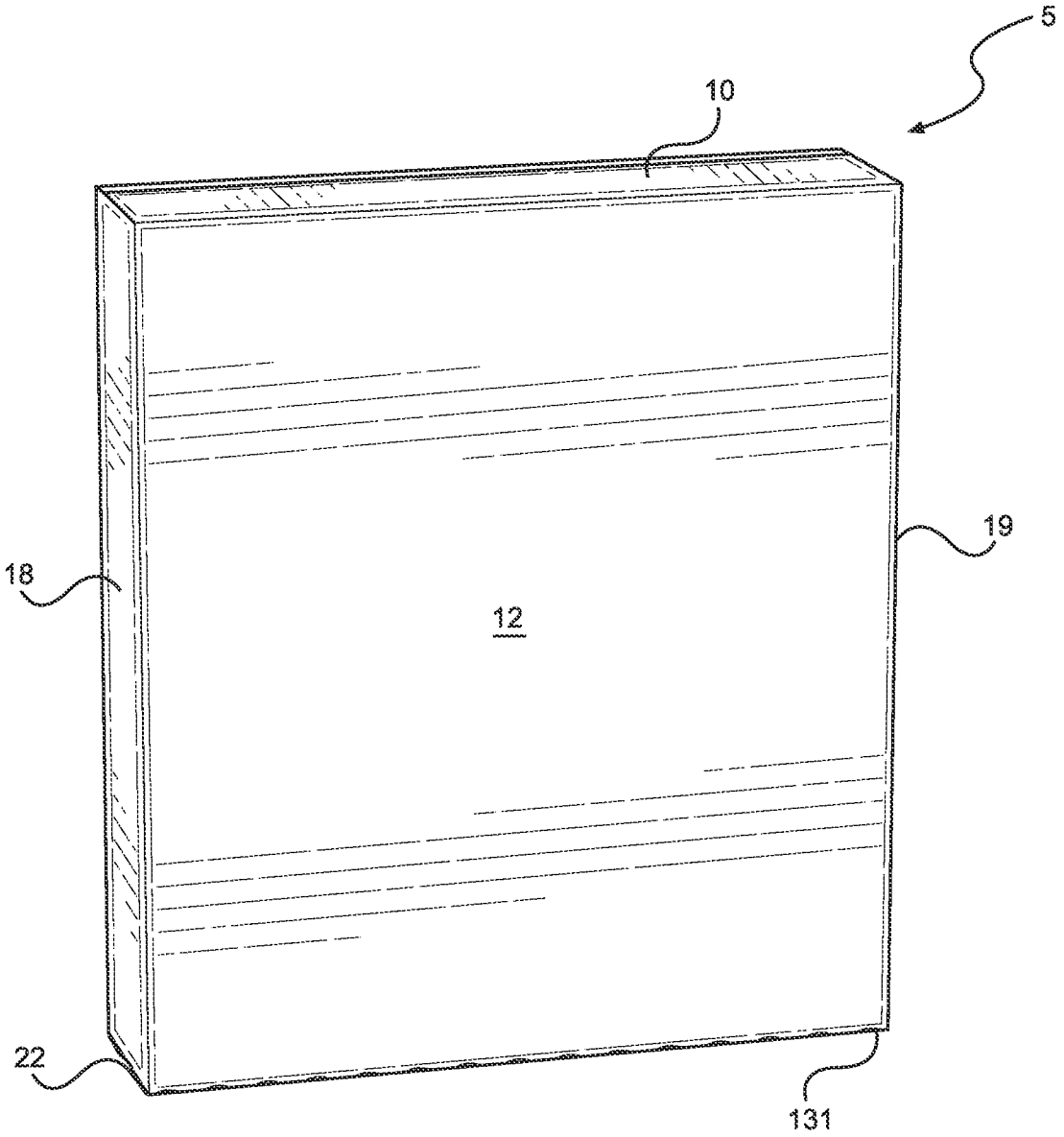
FIG. 1 is an upper perspective view of the carton constructed in accordance with the invention.

The following detailed description should be read with reference to the drawings in which similar elements in different drawings are numbered the same. The detailed description and the drawings, which are not necessarily to scale, set forth illustrative and exemplary embodiments and are not intended to limit the scope of the disclosure. Selected features of any illustrative embodiment can be incorporated into an additional embodiment unless clearly stated to the contrary. While the disclosure is amenable to various modifications and alternative forms, specifics thereof have been shown by way of example in the drawings and will be described in detail. As used herein in the specification and claims, including as used in the examples and unless otherwise expressly specified, all numbers may be read as if prefaced by the word "about" or "approximately," even if the term does not expressly appear, with it being understood that this provides a reasonable expected range of values in the order of +/−10% of the stated value (or range of values). In addition, any numerical range recited herein is intended to include all sub-ranges subsumed therein. Overall, it should be understood, however, that the intention is not to limit aspects of the disclosure to the particular illustrative embodiments described. On the contrary, the intention is to cover all modifications, equivalents, and alternatives falling within the spirit and scope of the disclosure.

Figure 2:
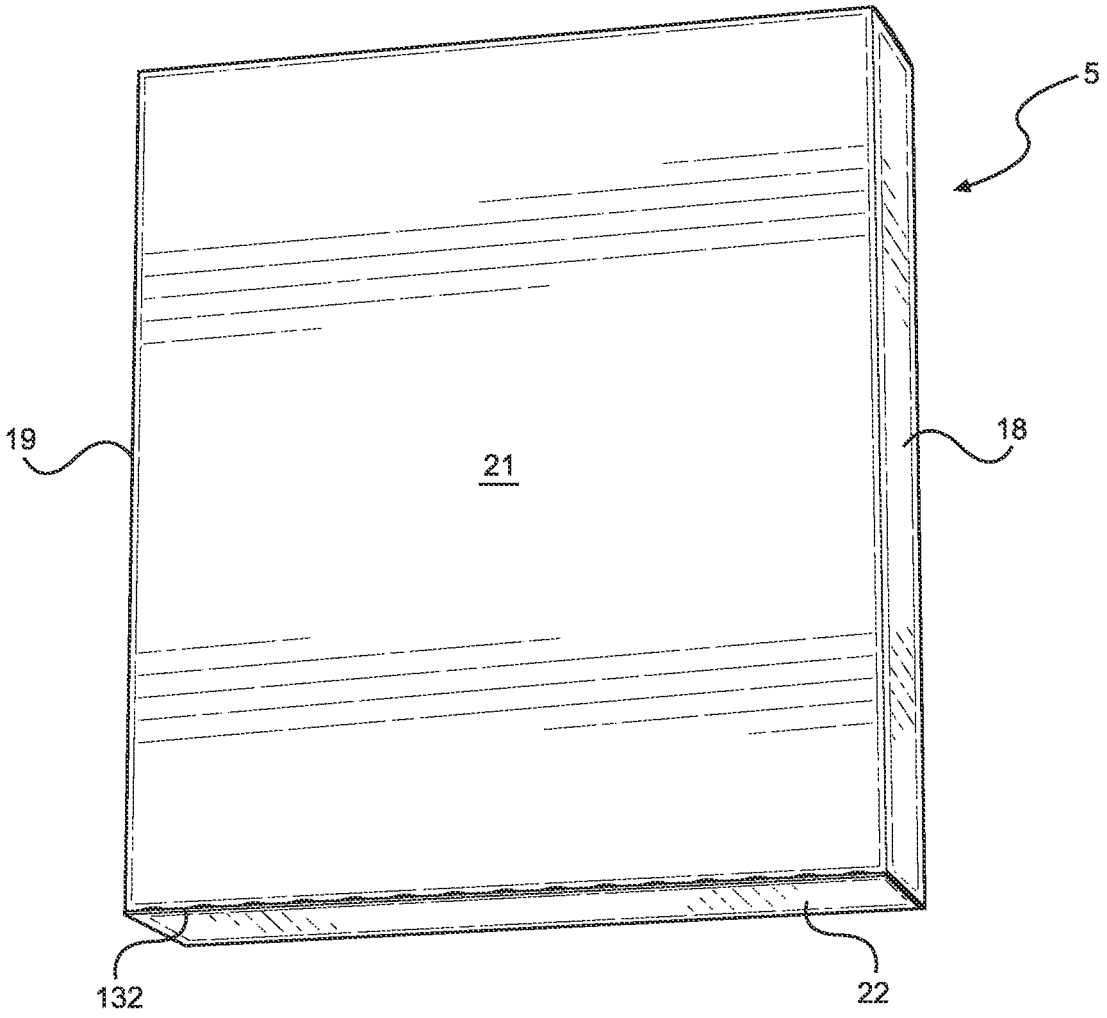
FIG. 2 is a lower rear perspective view of the carton of FIG. 1

With initial reference to FIGS. 1 and 2, a carton constructed in accordance with the present invention is generally indicated at 5. Carton 5 is preferably based on a regular six-sided container design. As such, carton 5 has six sides including a top 10, a front 12, left side 18 and right side 19, back 21 and a carton bottom 22 that are all rectangular in shape. FIG. 1 is an upper perspective view of carton and therefore shows front 12, left side 18 and top 10 of carton 5. FIG. 2 shows a lower rear perspective view of carton 5 and therefore shows back 21, left side 18 and bottom 22 of carton 5. Carton 5 is preferably made of cardboard or paperboard.

Figure 3:
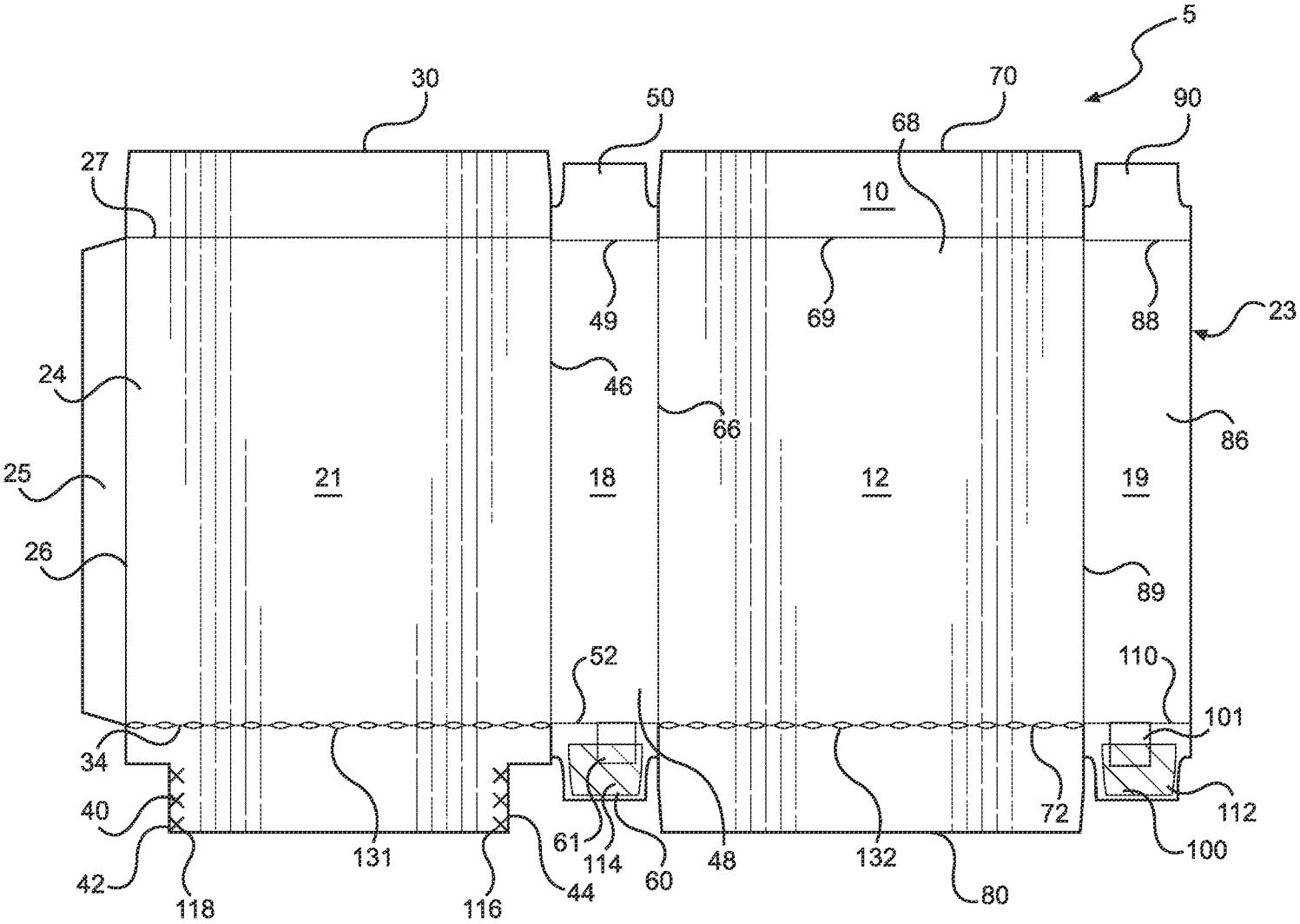
FIG. 3 is a plan view of a paperboard blank from which the carton of FIGS. 1 and 2 is erected.

In accordance with a preferred feature, carton 5 is formed from a blank 23 as shown in FIG. 3. Blank 23 can be made from various materials, particularly cardboard or paperboard which is widely known for use in the food industry for forming various types of food cartons. In any case, blank 23 is stamped from a single sheet to establish the various parts of the carton 5. Back 21 is defined by a rear panel 24. Rear panel 24 connects to a partial flap 25 via a fold line 26. Rear panel 24 also includes a second fold line 27 leading to a rear upper major flap 30, as well as a lower connecting fold line 34 leading to a rear lower major flap 40. As shown, rear lower major flap 40 includes spaced notches 42 and 44. Connected to rear panel 24 by a fold line 46 is a first or left side panel 48 defining left side 18. Left side panel 48 includes an upper connecting fold line 49 leading to a first upper minor flap 50. Left side panel 48 also includes a lower connecting fold line 52 connected to lower minor flap 60. Lower minor flap 60 is provided with embossment 61.

Left side panel 48 is also connected along a fold line 66 to a front panel 68 defining, in part, front 12. Front panel 68 has an associated upper connecting fold line 69 leading to front upper major flap 70 and a lower connecting fold line 72 leading to front lower major flap 80.

Carton 5 also includes a second or right side panel 86, forming right side 19 of carton 5. Right side panel 86 is connected along a fold line 89 to front panel 68. Right side panel 86 has an upper connecting fold line 88 joining right side panel 86 with right upper minor flap 90. Right side panel 86 is also connected to lower minor flap 100. Lower minor flap 100 is provided with an embossment 101 and a fold line 110 connecting lower minor flap 100 to right side panel 86. Preferably glue 112 is provided on lower minor flap 100 and covers embossment 101 while more glue 114 is provided on lower minor flap 60 and covers embossment 61. Additional glue 116, 118 is optionally added to lower major flap 40.

A method of forming blank 23 is as follows. In assembling blank 23 of FIG. 3 into carton 5 of FIGS. 1 and 2, various panels are folded along lines 26, 46, 66, 89 and 110, with side panel 86 being secured to partial flap 25, preferably by adhesive, thus forming the front 12, back 21, left side 18 and right side 19 of box 5. Thereafter, upper minor flaps 50 and 90 are folded along fold lines 49 and 88 respectively. Likewise, upper major flaps 30 and 70 are folded along fold lines 27 and 69 to form top 10. In closing off the remainder of carton 5, lower minor flap 60 and lower minor flap 100 are folded along fold lines 52 and 110, respectively. Then rear lower major flap 40 is folded at fold line 34 and front lower major flap 80 is folded along fold line 72 to form the carton bottom 22 of carton 5 as shown in FIG. 2. Carton bottom 22 is thus formed of four tabs that extend from the front, sides and back.

Figure 4:
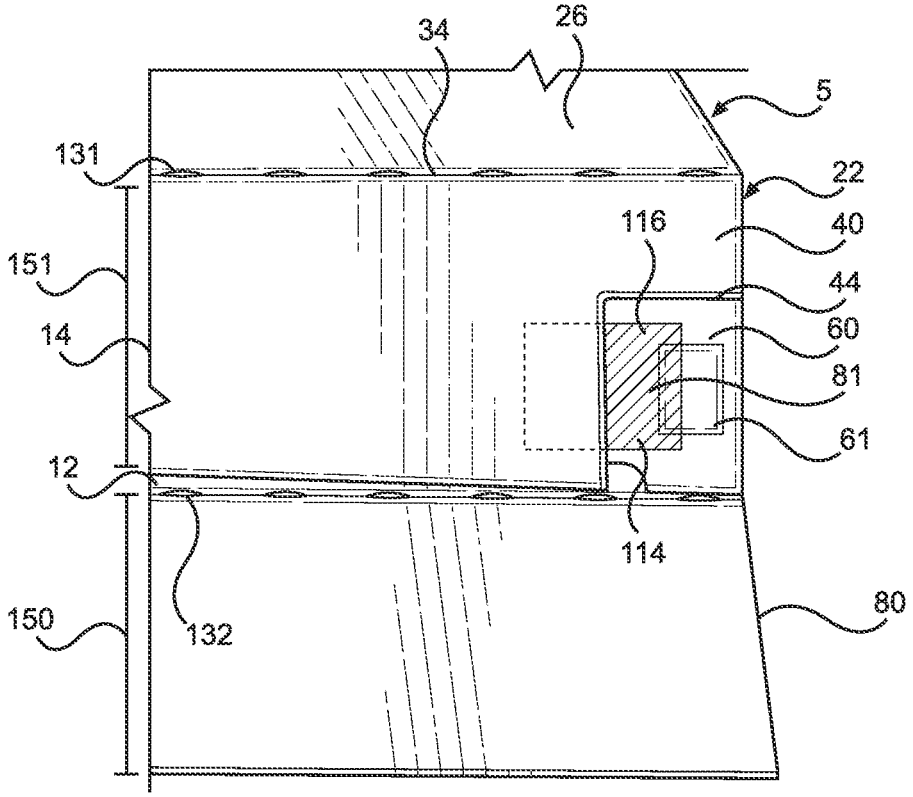
FIG. 4 is a partial lower perspective view of the carton of FIG. 1 showing a major flap in an open configuration to show the features providing for stability of the carton.

Turning now to FIG. 4, there is shown a close-up view of carton bottom 22 of carton 5. In accordance with a first feature of the invention, rear lower major flap 40 is formed with a notch 44 having a particular shape. In this case, notch 44 is formed as a rectangle but other shapes could be employed. Notch 44 is basically an area that has been cut out of rear lower major flap 40. Lower minor flap 60 is formed with an embossment 61. Embossment 61 is formed by imprinting embossment 61 into lower minor flap 60. Lower minor flap 60 is pressed to form an indentation or recess on one side of lower minor flap 60. In this case the indentation is on the inside of carton 5. A protrusion is formed on the other side of lower minor flap 60. Embossment 61 is sized and shaped so that embossment 61 fits into the shape of notch 44. Preferably, both of the lower minor flaps 60, 100 have embossments 61, 101. Also, notch 44 preferably has a shape e.g., a rectangle, that complements the outer shape of embossment 61 e.g., also a rectangle. Preferably, embossment 61 extends from lower minor flap 60 and distance equal to a thickness of rear lower major flap 40. Embossment 61 on lower minor flap 60 helps ensure the glue at 114 and 116 more tightly seals the minor 60 and major flaps 40, 80 together thus removing the tendency for the bottom of carton 5 to be rounded. Embossment 61 allows carton bottom 22 of carton 5 to be flat thus increasing the stability of carton 5 when carton 5 is placed upright on a shelf (not shown).

With continuing reference to FIG. 4 and in accordance with a second preferred feature, bottom 22 of carton 5 is formed by an enlarged first lower major 80. For example, front lower major flap 80 preferably extends a distance 150 completely across carton bottom 22 as shown at 151. Preferably, a second lower major flap 40 also extends completely across carton bottom 22. Such an arrangement removes an unstable point at the middle of the carton bottom wherein a transition from two to three board thicknesses exists in the prior art arrangement, such as shown in FIG. 5.

As also shown in FIG. 4 and in a third preferred feature of the invention, rear panel 24 and rear lower major flap 40 are connected along a first fold line 34 which is formed with cut sections 131. Preferably, each cut section 131 has a cut length and between each cut section 131 fold line 34 has an uncut length, and the uncut length is longer than the cut length. These cut sections 131 alternate with uncut sections, and are also known as skip cuts, along the fold line 34, make carton 5 easier to fold. In particular, during manufacturing, the edge formed along the fold line 34 forms an angle that is closer to 90 degrees when compared to folds made without the skipping cuts. In addition, a second set of cut sections 132 is formed on fold line 72 and acts in a similar manner to cut sections 131. Once again, such folds lead to carton bottom 22 being flatter and thus a more stable carton 5.

Carton 5 can contain various items but preferably contains food. The dimensions of carton 5 are arranged so that carton 5 is taller than it is deep. The carton preferably has a height vs depth ratio of at least 2:1. Embossment 61 also cooperates with notch 44, front lower major flap 80 and cut sections 131, again, to help prevent carton 5 from tipping over. All three features can be used in combination so that fitting embossment 61 into notch 44; extending first lower major flap 80 completely across bottom 22; and cutting along a fold line 34 between front panel 24 and rear lower major flap 40 to form cut sections 131 and uncut lengths along fold line 34; collectively constitute stabilizing carton 5 by forming a flat bottom 22 of carton 5 to allow carton 5 to resist tipping over easily.

Figure 5:
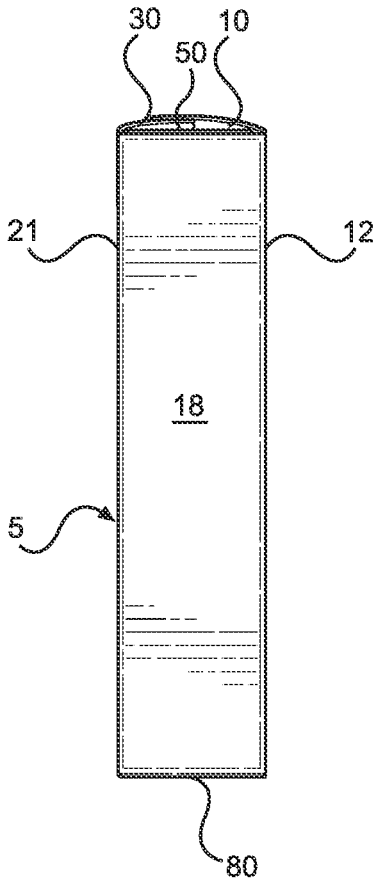
FIG. 5 is a side view of the carton of FIGS. 1 and 2.
Figure 6:
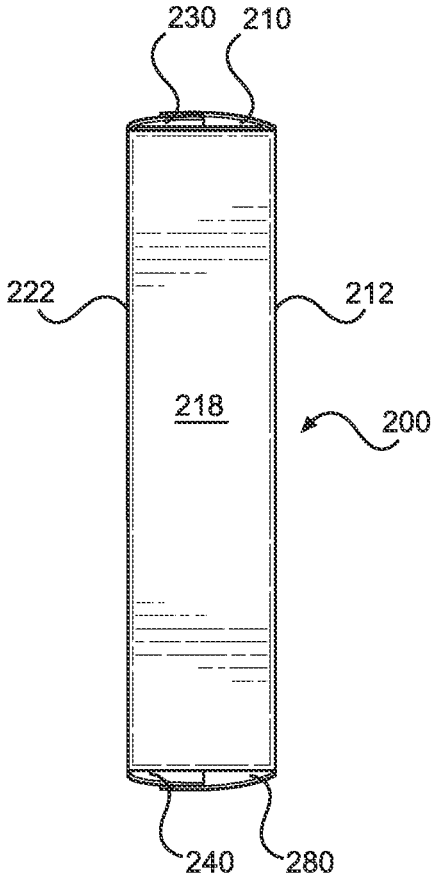
FIG. 6 PRIOR ART
FIG. 6 is a side view of a prior art carton.

Turning to FIG. 5, there is shown a carton 5, in accordance with the preferred features, with front lower major flap 80 shown at the bottom of carton 5. FIG. 6 shows a prior art carton 200 having a front side 212, a left side 218 and a back side 222. The prior art carton 200 has upper flaps 210, 230 and bottom flaps 240, 280. As can clearly be seen in FIG. 6, bottom flaps 240 and 280 form a rounded bottom of carton 200 when compared to carton 5 having the preferred features.

Figure 7:
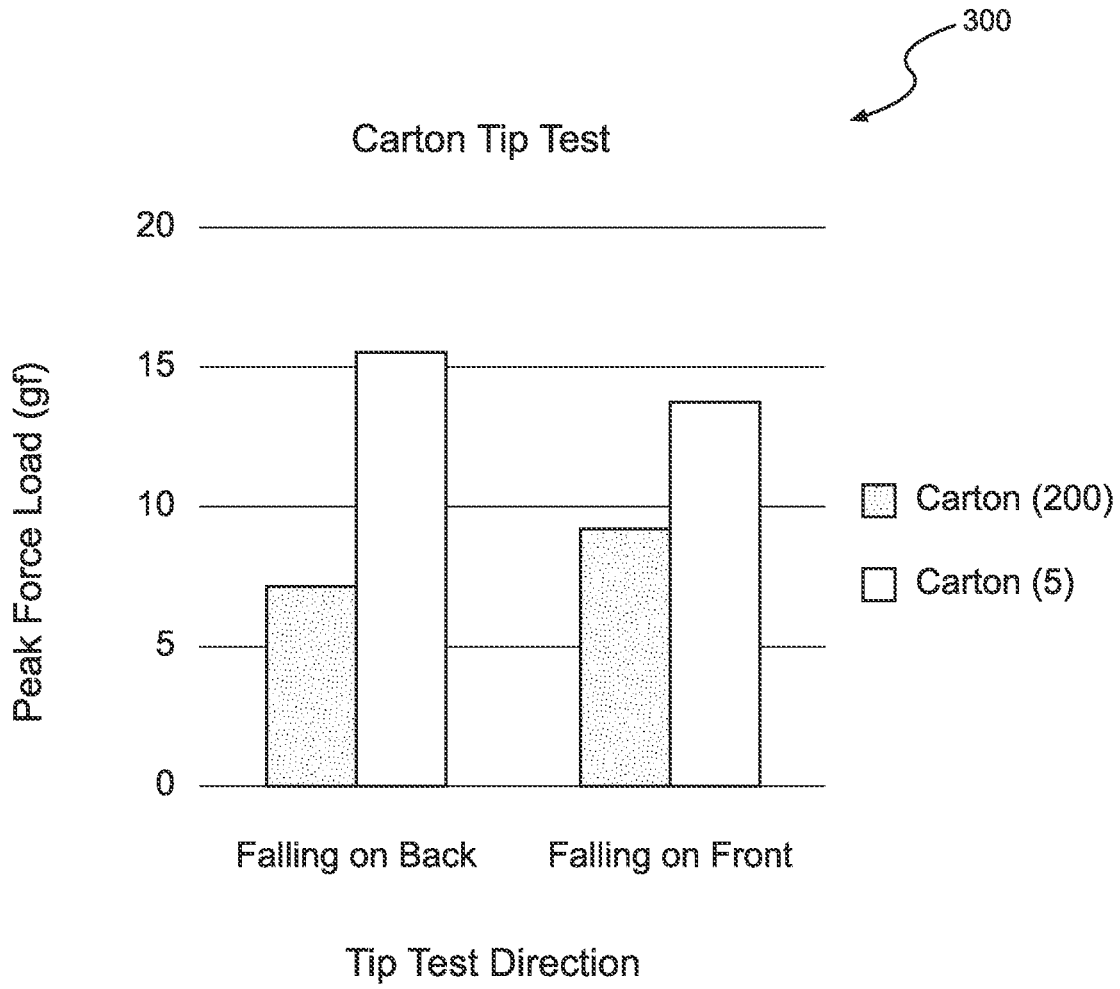
FIG. 7 is a chart comparing the carton shown in FIG. 5 with the carton shown in FIG. 6.

Turning to FIG. 7, a comparison between carton 5 and prior art carton 200 is shown in graph 300. The prior art, carton 200 is compared to the new carton, carton 5. As can be seen from the graph, the force required to tip new carton 5 is much greater than what is required to tip prior art carton 200. For example, the original prior art carton 200 will fall backwards with well under 10 grams of force (7.2 gf) while carton 5 will require over 15 grams of force. Also, the original prior art carton 200 will fall forward with under 10 grams of force, while carton 5 will require nearly 15 grams of force to fall forward.

Based on the above, it should be readily apparent that the invention provides for carton that is much less likely to fall over when compared to prior art designs. In any case, although disclosed with reference to preferred embodiments of the invention, it should be readily apparent that various changes and modifications can be made to the invention without departing from the spirit thereof. Instead, the invention is only intended to be limited by the scope of the following claims.

The invention claimed is:

1. A carton comprising:

a front panel with a first lower major flap;

a rear panel with a second lower major flap;

a first side panel with a first lower minor flap;

a second side panel with a second lower minor flap; and a bottom formed from the first and second lower minor flaps and first and second lower major flaps, wherein one of the first and second lower major flaps is formed with a notch having a shape, and one of the first and second lower minor flaps is formed with an embossment that has a shape that fits into the shape of the notch, the embossment is formed as a recess on a first side of the first lower minor flap and a protrusion on a second side of the first lower minor flap, and the protrusion extends from the first lower minor flap a distance equal to a thickness of the first major flap.

2. The carton of claim 1, wherein the embossment has an outer shape that is complementary to the shape of the notch.

3. The carton of claim 1, wherein the first lower major flap extends completely across the bottom.

4. The carton of claim 3, wherein the second lower major flap extends completely across the bottom.

5. The carton of claim 1 further comprising a top and containing food.

6. The carton of claim 1 wherein the carton has a height vs depth ratio of at least 2:1, and the embossment prevents the carton from tipping over easily.

7. A carton comprising:

a front panel with a first lower major flap;

a rear panel with a second lower major flap;

a first side panel with a first lower minor flap;

a second side panel with a second lower minor flap; and a bottom formed from the first and second lower minor flaps and first and second lower major flaps, wherein one of the first and second lower major flaps is formed with a notch having a shape, and one of the first and second lower minor flaps is formed with an embossment that has a shape that fits into the shape of the notch, the embossment is formed as a recess on a first side of the first lower minor flap and a protrusion on a second side of the first lower minor flap, wherein the rear panel and the second lower major flap are connected along a fold line and the fold line is formed with cut sections.

8. The carton of claim 7, wherein each cut section has a cut length and between each cut section the fold line has uncut length, and the uncut length is longer than the cut length.

9. The carton of claim 8 wherein the carton has a height vs depth ratio of at least 3:1, and the embossment cooperates with the notch, the major flap and the cut sections to help prevent the carton from tipping over.

10. A method of forming a stabilized carton having a front panel with a first lower major flap, a rear panel with a second lower major flap, a first side panel with a first lower minor flap, a second side panel with a second lower minor flap; and a bottom, said method comprising:

cutting a notch having a shape in one of the first and second lower flaps;

imprinting an embossment into another of the first and second lower flaps, wherein imprinting the embossment includes pressing the first lower minor flap to form a recess on a first side of the first lower minor flap and a protrusion on a second side of the first lower minor flap; and folding first and second lower minor flaps and first and second lower major flaps; while fitting the embossment into the notch so that the protrusion extends from the first lower minor flap a distance equal to a thickness of the first major flap.

11. The method of claim 10, further comprising extending the first lower major flap completely across the bottom.

12. The method of claim 11, further comprising cutting along a fold line between the rear panel and the second lower major flap to form cut sections and uncut lengths along the fold line.

13. The method of claim 12, wherein fitting the embossment into the notch; extending the first lower major flap completely across the bottom; and cutting along a fold line between the rear panel and the second lower major flap to form cut sections and uncut lengths along the fold line; collectively constitute stabilizing the carton by forming a flat bottom of the carton to allow the carton to resist tipping.

* * * * *